United States Patent [19]

Wilson

[11] 3,949,962

[45] Apr. 13, 1976

[54] COLLAPSIBLE UMBRELLA CONCRETE FORM

[76] Inventor: Arnold Wilson, 415 E. Maple, Mapleton, Utah 84663

[22] Filed: Sept. 25, 1974

[21] Appl. No.: 508,958

[52] U.S. Cl. ..... 249/18; 135/2; 135/20 R; 249/212

[51] Int. Cl.[2] ..... E04G 11/36

[58] Field of Search ..... 249/13, 18, 207, 209, 210, 249/212; 135/2, 20 R, 27, 37–39

[56] References Cited

UNITED STATES PATENTS

| | | | |
|---|---|---|---|
| 230,384 | 7/1880 | Wolff | 249/91 |
| 574,091 | 12/1896 | Irvine, Jr. | 135/2 |
| 892,698 | 7/1908 | Whinnery | 135/2 |
| 1,031,868 | 7/1912 | Peterson | 135/27 |
| 1,034,846 | 8/1912 | Thomas | 135/27 |
| 1,175,476 | 3/1916 | Schultz, Jr. | 135/20 R |
| 2,661,752 | 12/1953 | Kampf et al. | 135/2 |
| 3,213,868 | 10/1965 | Forbes | 135/2 |
| 3,626,958 | 12/1971 | Ross | 135/2 |

FOREIGN PATENTS OR APPLICATIONS

| | | | |
|---|---|---|---|
| 1,436,059 | 3/1966 | France | 135/20 R |
| 24,632 | 10/1914 | United Kingdom | 135/20 R |
| 490,484 | 2/1954 | Italy | 135/2 |

*Primary Examiner*—Francis S. Husar
*Assistant Examiner*—John McQuade
*Attorney, Agent, or Firm*—Lynn G. Foster

[57] ABSTRACT

A collapsible and reusable umbrella concrete form for casting a concrete shell roof in the form of a dome, the collapsible umbrella form comprising a central stem or column equipped with a base, a jack abutment plate for vertically adjusting the stem in respect to the base, the jack abutment plate being immediately above the base, a rib support connector at the top of the column, and a plurality of strut connectors slidably carried by the central portion of the column, each being axially displacable along the column but keyed so as to be non-rotatable in respect to the column. The top connector of the column releasably receives the upper end of each rib support, each rib support being radially disposed outwardly and arcuately downwardly from said top column connector, the array of rib connectors in plan view giving the appearance of radial spokes, each equally angularly spaced from the next, and being connected one to the other by a plurality of ring members, one ring member defining the outer periphery of the form. Each rib support is held in the described arcuately depending disposition against collapse by three diagonal strut members bridging between an intermediate location along the rib support and one of the strut connectors. The degree of arc and the effective radius spanned by the rib supports may be varied within limits depending upon the relative position of the strut connectors along the length of the column. A suitable jack or like mechanism is used to position the strut connectors along the column and once said connectors are placed as desired, one or more pins may be used to retain that location. To compensate for changes in the circumference of the outer ring caused by displacement of the strut connectors a turnbuckle mechanism comprises part of the outer ring. Radial panels are flush with the top of the rib supports and span between the rib supports and the ring members over at least the distal one half of the array of ring and rib support members. These panels may be fabricated of any suitable material such as plywood to support concrete as it is placed and to leave an acceptable interior roof surface once the umbrella concrete form is removed by relaxing the rib support members as a result of lowering the strut connectors along the column. A sheet of fabric such as nylon is placed over the entire upper surface of the form and is installed in such a way as to become taut when the form is upwardly and outwardly flexed so that it not only supports concrete between the rib and ring members where no support panel exists but also leaves a suitable exposed roof surface once the form has been removed. Once assembled with the sheet of fabric across the top of the form, a thin layer of concrete is placed over the fabric and also upon precast concrete or like pre-existing structural columns disposed along the periphery of the form. The pre-existing structural columns support the concrete roof once it has set and cured and the form has been removed.

16 Claims, 12 Drawing Figures

COLLAPSIBLE UMBRELLA CONCRETE FORM

BACKGROUND

1. Field of Invention

The present invention relates generally to reusable concrete forms and more particularly to a collapsible and reusable umbrella concrete form for producing concrete shell roofs for low-cost housing and the like.

2. Prior Art

With inflation, particularly the high rate of inflation which has occurred during the last three years, low-cost housing is said by many to be a thing of the past. Nevertheless, while a substantial percentage to the people cannot pay the spiraling prices being asked for residential homes, approximately twenty six million new single family dwellings will be needed in the United States to accommodate anticipated demand during the next ten years. As a result, some way is needed for producing an economically acceptable single family dwelling, which is also attractive, comfortable and safe. A number of prior proposals have been made including prefabricated dwellings, modular construction and even government subsidies. However, utilization of concrete shell roofs on such dwellings, as heretofore proposed, results in very little if any financial savings in construction. Normally, the forms are expensive and complicated and require expert technicians to assemble and disassemble; also a large number of man hours must be invested. Thus, the resulting concrete shell roof using prior art forms and methods is no more economical than other forms of construction.

BRIEF SUMMARY AND OBJECTS OF THE PRESENT INVENTION

The present invention provides a collapsible, reusable umbrella concrete form for creating a thin shelled concrete roof on a far more economical basis than heretofore proposed. The concrete form consists of a central column, a base which accommodates vertical adjustment of the column in respect to the base, a top connector whereby a plurality of rib supports and ring members create an outwardly and downwardly extending frame array which supports the concrete temporarily as it is placed on said form and upon precast concrete or like structural columns and until the concrete so placed has set and cured as a thin shell dome roof. The mentioned frame array is held in the desired position to receive concrete by a plurality of diagonal struts respectively preferably connecting to two or more intermediate strut connectors which may be caused to slide along the central column. By relatively displacing the strut connectors along the column, the frame array is flexed or, alternatively, relaxed as desired so that the effective radius or diameter thereof is increased or decreased. Thus, the effective diameter is progressively enlarged by displacing the mentioned connectors upwardly until the outer periphery of the frame array is essentially contiguous with said precast concrete or like structural columns and, after the concrete has been placed, set and cured, opposite displacement will relax the frame array making it easy to remove the concrete form without technical assistance. Radial panels which are flush with the top of the rib supports may be used to bridge between and providing support intermediate the rib and ring members and, preferably, a flexible fabric is placed across the top of the frame array and stretched taut when the array is flexed into its concrete-receiving disposition to thereby support concrete in locations where panels do not exist and to leave a suitable interior roof surface.

With the foregoing in mind, it is a primary object of the present invention to provide an improved concrete form.

Another paramount object of the present invention is the provision of a collapsible, reusable umbrella concrete form which may be readily assembled and disassembled for reuse without using specially trained personnel.

A further significant object of the present invention is to provide, for use in low-cost housing, a novel umbrella concrete form which may be erected and flexed into a desired curved configuration for receiving concrete to form a roof and thereafter may be relaxed and readily removed.

These and other objects and features of the present invention will be apparent from the following detailed description, taken with reference to the accompanying drawings.

DETAILED DESCRIPTION OF THE ILLUSTRATED EMBODIMENT

Figure 4:
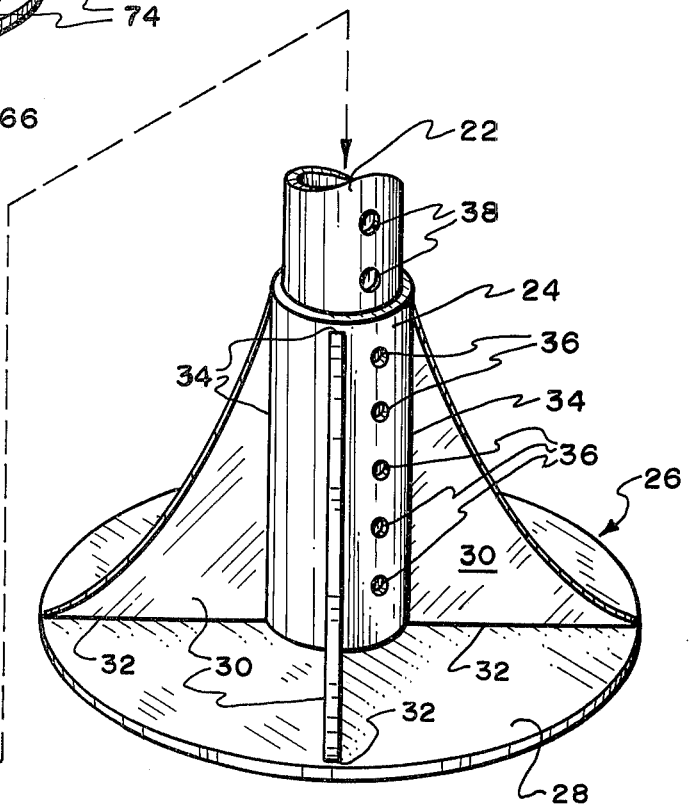
FIG. 4 is an enlarged fragmentary perspective representation with parts broken away for clarity of the central form column with various connectors slidably secured thereto.

Reference is now made to the drawings wherein like numerals are used to designate like parts throughout. The drawings illustrate a presently preferred collapsible, reusable umbrella concrete form, generally designated 20, used to create a concrete shell roof for low-cost housing. The concrete form 20 comprises a vertical column or stem 22 illustrated as comprising a hollow pipe of mild steel having certain aligned pairs of apertures placed through the wall thereof for purposes hereinafter more fully explained. The column 22, best illustrated in FIG. 4, fits loosely within a sleeve 24 of a base member 26. The base member 26 also comprises a ground or floor-engaging plate 28 to which the lower edge of the sleeve 24 is welded and four vertically oriented gusset plates 30 disposed at 90° intervals with respect to each other and welded at interfaces 32 to the base plate 28 and at interfaces 34 to the sleeve 24. A plurality of aligned pairs of vertically aligned apertures 36 are provided in the sleeve 24, only one of each said pair being illustrated. One pair of the apertures 38, disposed in the column 22 near its lower end, aligned with a desired pair of apertures 36 and a pin, bolt or the like is placed through said two pairs of apertures for a purpose hereinafter more fully described. A jack abutment 40 is located a short distance above the base member 26. The jack abutment 40 comprises a horizontal rectangular plate 42, an upward extending collar 44 which loosely circumscribes the column 22 and comprises radially disposed aligned pairs of apertures 46 therein, the lower edge of the collar 44 being welded to the plate 42 and a plurality of vertically disposed gusset supports 48 being disposed between and butt welded to the plate 42 and the collar 44. A pin or the like may be placed through any selected pair of apertures 46 and an aligned pair of apertures 50 in the column 22 to secure the jack abutment at a desired elevation immediately above the base member 26. Thus, with the column 22 free to move axially in respect to the base member 26, a jack or the like may be placed upon the top surface of the plate 28 and caused to engage the bottom surface of the plate 42. By appropriately manipulating the jack, the abutment member 40 along with the column 22 (and all which the column 22 supports) will be lifted (or lowered) until the top of the column 22 is disposed at the desired height.

A plurality of strut connectors 60, 62 and 64 are slidably concentrically carried by the column 22 intermediate its length, each being independantly rectilinearly displacable up and down along the column and capable of being secured in any desired location along the column by placing a suitable pin through a selected aligned pair of apertures 66 in the downwardly extending collar 68 of the strut connector and through an aligned pair of apertures 70 in the column 22. Each strut connector 60, 62 and 64 comprises, in addition to a downwardly extending apertured collar 68, a round horizontal upper plate 72 having equally spaced aperture 74 along the periphery thereof and a key way housing 76 which loosely surrounds a key 78 rigidly mounted to the exterior of the column 22 to avoid rotation of the connectors. Vertically oriented gusset members 80, welded to the exterior surface of each collar 68 and the lower surface of each plate 72 provide structural strength adequate to support the load as hereinafter will be more apparent.

It should be readily apparent that each plate 72 may serve adequately to receive a hydraulic or like jack for displacing the strut connector 72 when load bearing, i.e. when connected by struts to the upper portion of the concrete form 20. However, when the struts are not connected, manipulation of the connectors and of pins into and out of the aligned pairs of apertures 66–70 may be attended to manually.

A top, rib connector member 90 (FIG. 3) is located at the top (distal) end of the column 22 and comprises a horizontally disposed circular plate 92 having an array of peripheral apertures 74, similar to apertures 74 of plate 72. The plate 92 is welded to a depending collar 94, which loosely fits concentrically over the column 22 and is secured against inadvertent removal by a pin passing through one aligned pair of its apertures 96 as well as an aligned pair of apertures (not shown) in the upper end of the column 22.

Figure 5:
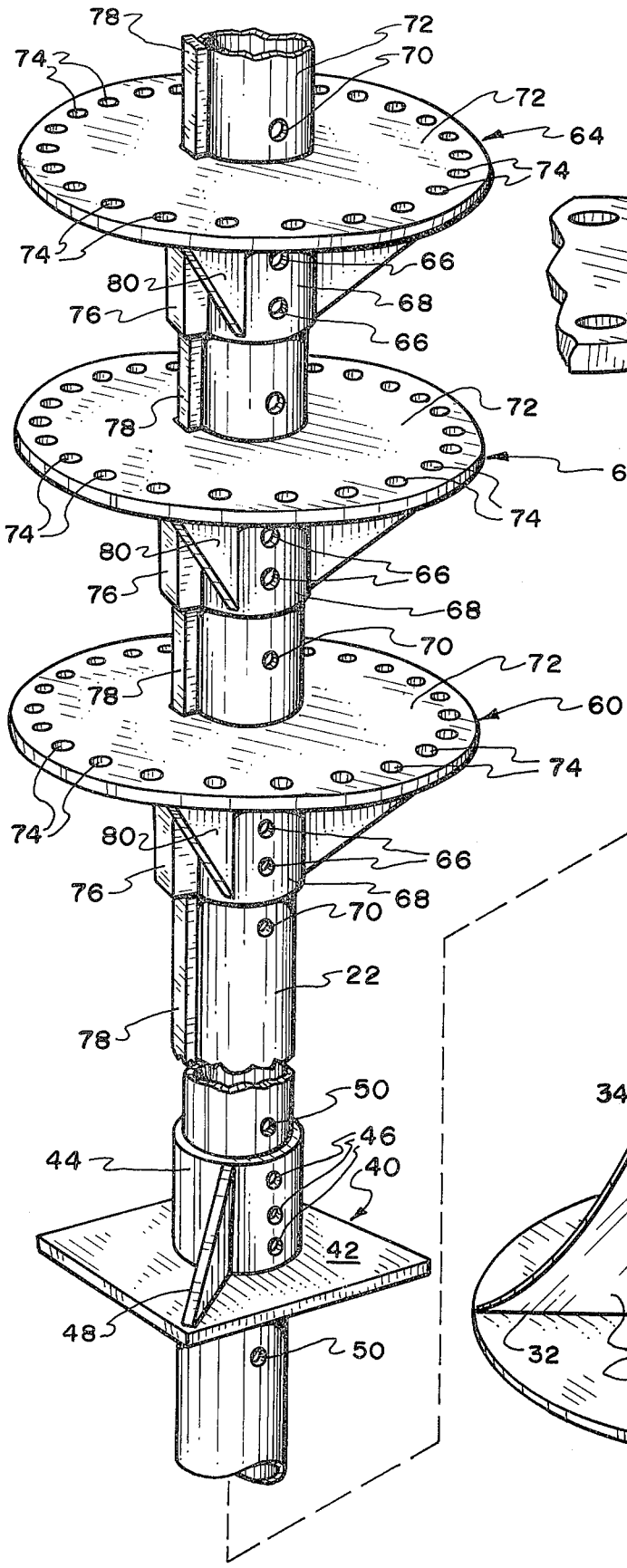
FIG. 5 is a fragmentary enlarged perspective representation of the manner in which the struts and rib supports of the concrete form of FIG. 1 are joined to the connectors carried by the column.
Figure 5:
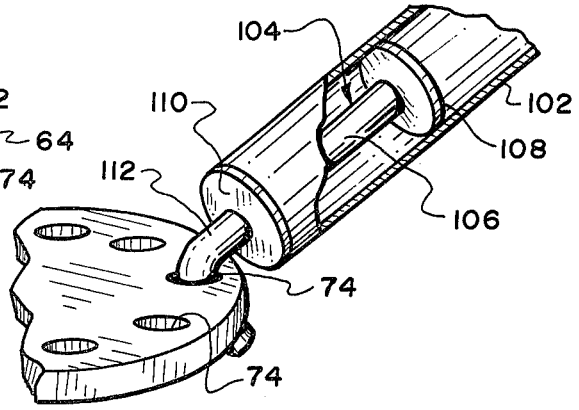

The concrete form 20 comprises an array of support members which create a frame array, generally designated 100, which is illustrated as taking the shape of a spherical dome. Naturally the scope of the present invention embraces other shapes. The frame array 100 comprises a plurality of radially projecting and downwardly arcuately curved rib supports 102. When viewed in plan, the rib supports 102 generally appear as the spokes of a wheel. Each rib support 102 comprises a hollow round steel conduit and is releasably joined to the horizontal plate 92 of the top connector 90 by an anchor member 104 (FIG. 5). Each anchor member 104 fits into the hollow upper end of the associated rib member 102, comprising a spool including a central shaft 106 and flanges 108 and 110. The diameter of the flange 108 is essentially equal to the inside diameter of the rib support 102 while the diameter of the flange 110 is essentially equal to the outside diameter of the tube comprising the rib support 102. The spool is preferably welded in the position illustrated in FIG. 5 and comprises an L-shaped rod projection 112, the free end of which is fitted downwardly into and through a selected aperture 74 in the plate 92.

Figure 6:
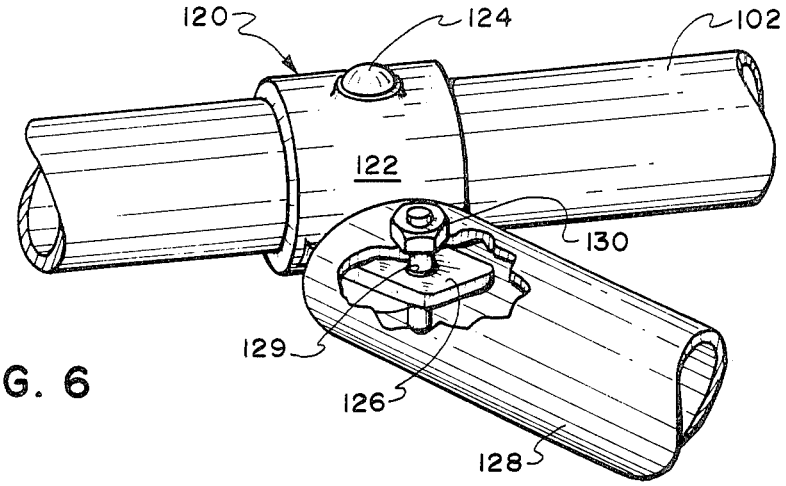
FIG. 6 is an enlarged fragmentary representation of one of the T fasteners used to join the upper end of each strut to a rib support.

Each rib support 102 is illustrated (FIG. 6) as carrying three spaced T fittings 120 in fixed positions. Each T fitting 120 comprises an enlarged loop 122, the inside diameter which is substantially greater than the outside diameter of the conduit forming the rib support 102, the loop 122 being secured to the rib support 102 at a desired location by placement of a bolt 124 through aligned pairs of apertures in the opposite sides of the loop 122 and rib support 102. The T fitting 120 also comprises a male flange 126 extending downwardly and inwardly at an acute angle. The flange 126 is integral with the loop 122 and sized so as to loosely extend into the upper end of the associated diagonal strut 128. A bolt 130 passes loosely through aligned pairs of apertures in the opposed walls of the conduit comprising the strut 128 and through a central aperture 129 in the flange 126 and is secured in such a fashion as to permit a limited amount of angular adjustment between the strut 128 and the flange 126 to accommodate the mentioned flexing and relaxing of the concrete form 20.

Figure 7:
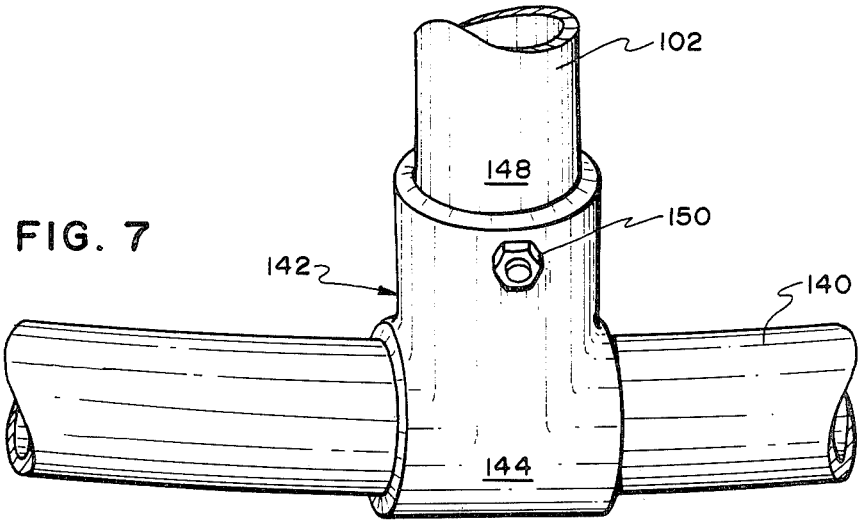
FIG. 7 is an enlarged fragmentary perspective representation of the T connector by which the distal ends of the rib supports are joined to the outer ring.

Each rib support 102 is joined to an outer ring 140 using T fittings 142 (FIG. 7). Each T fitting 142 comprises a loop 144 the inside diameter of which is larger than the outside diameter of the conduit forming the ring member 140 with the ring member 140 passing loosely through the loop 144. The T connector 142 also comprises a female hub 146 defining a female bore into which the distal end 148 of the associated rib support 102 extends in spaced relation. The end 148 is secured in the indicated position by utilization of a bolt 150 which passes through aligned pairs of openings in the opposed walls of the hub 146 and the end 148.

A plurality of intermediate ring members, generally designated 160, connect the rib supports in somewhat of a spider web fashion, each intermediate ring support 160 comprising hollow conduit sections 162 interposed between adjacent rib members 103. See FIG. 9.

The ends of adjacent rib sections 102 are secured one to the other and also to the associated rib member 102 by connectors 164. Each connector 164 comprises a U-shaped hanger 166, the upper ends of which are welded to the lower external surface of the adjacent rib support 102. Oppositely projecting rods 168 are respectively connected to the U-shaped hangers and are respectively connected to cylindrical inserts 170, which are welded into the hollow of the associated ring section 162. The effective length of each Section 162 can be increased or decreased manually to fit the final form position and support the panels 200.

Figure 8:
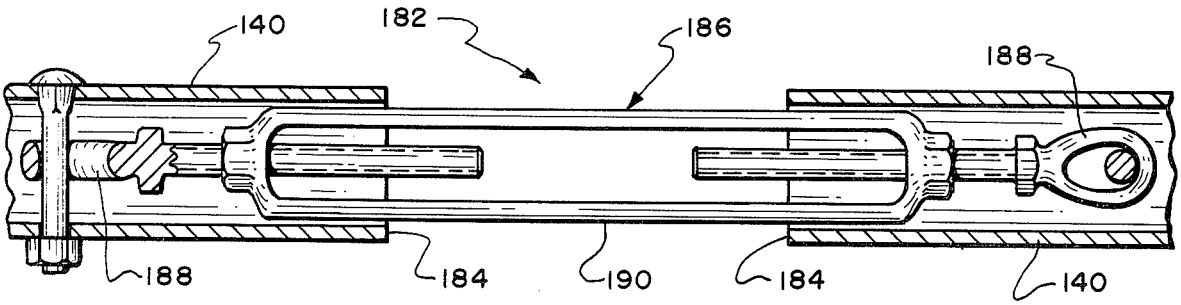
FIG. 8 illustrates in enlarged fragmentary perspective a turnbuckle mechanism for expanding and contracting the circumference of the outer ring of the concrete form of FIG. 1.

When the frame array is flexed and relaxed it is necessary to increase and decrease the circumferential length of the outer ring 140. One and preferably a plurality of turnbuckle mechanisms 182 of FIG. 8 amply provides for such required limited circumferential adjustment. More specifically, the continuity of the outer ring 140 is broken from place to place such as at location 184 in FIGS. 2 and 8. Thus, two free ends exist and into each two adjacent ends are placed a conventional turnbuckle 186 having looped ends 188 through which bolts or the like pass, each bolt is flush with the top of the outer ring 140 and the threaded end of the bolt is exposed and secured by a nut at the underside of the ring 140. Thus, the loops 188 are secured against rotation. Thus, by mechanically or manually turning the central elliptical member 190 of each turnbuckle 186 in one direction, the effective circumference of the outer ring 140 is increased and by turning it in the opposite direction the circumference is decreased.

Figures 1, 2:
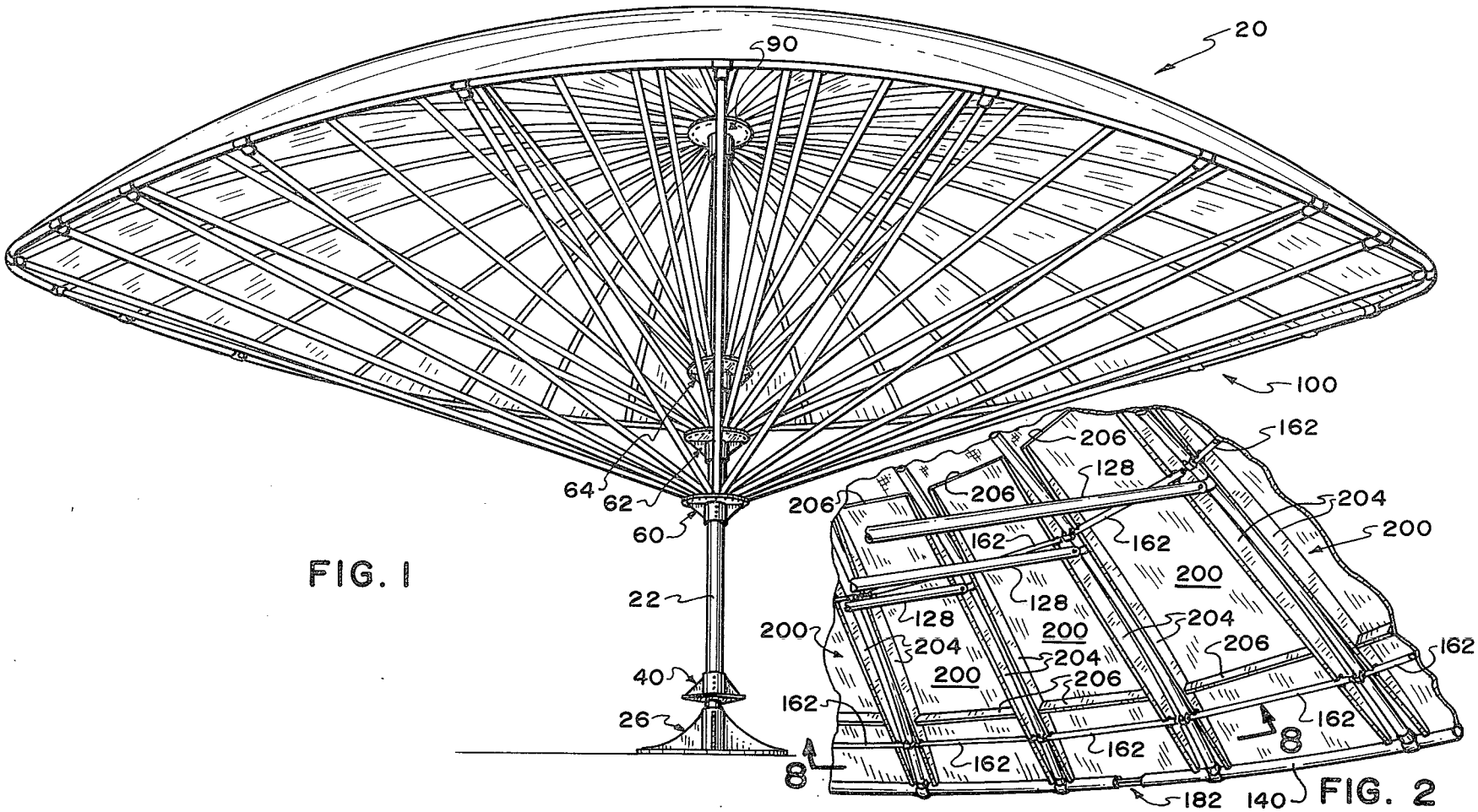
FIG. 1 is a prespective representation of a presently preferred collapsible, reusable umbrella concrete form as viewed upwardly from the under side thereof.
FIG. 2 is an enlarged fragmentary perspective representation of a portion of the underside of the concrete form of FIG. 1.
Figure 9:
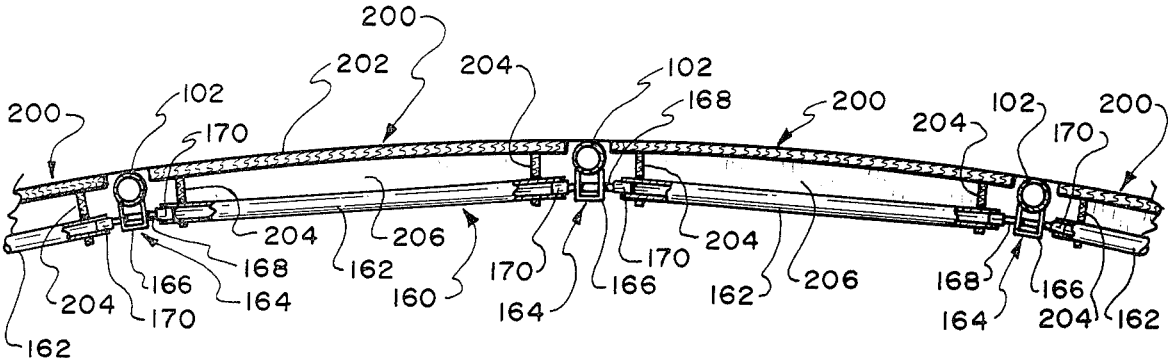
FIG. 9 is an enlarged fragmentary cross-sectional view taken along lines 8–8 of FIG. 2.

As best seen in FIGS. 1, 2 and 9, a plurality of radial panels are shown as being located toward the outer periphery of the form 20 and there rest by force of gravity between adjacent rib supports 102 and adjacent ring supports 140 and 162 flush with the top of the rib supports. Each radial panel 200 comprises an upper member 202, which may be fabricated of plywood or the like, as well as downwardly extending radial supports 204 and cross supports 206. The cross supports 206 are situated so as to avoid interference with any of the structural members comprising the form 20 while the radial members 204 have cut out portions through which the ring sections pass. While the panels 200 may be fabricated to fill all spaces between adjacent rib and ring members, the illustrated embodiment shows panels 200 being used only to fill such spaces as exist between the outer ring support 140 to a radial location approximately half way along the length of the rib members 102. It is to be appreciated that the mentioned panel members 200 rest by force of gravity upon the ring sections 162 at the cut out portions thereof and may be readily lifted manually from the illustrated position. Also, the mentioned panels 200 are sized to fit where the frame array is relaxed and, therefore, do not interfer when the array is flexed.

Figure 11:
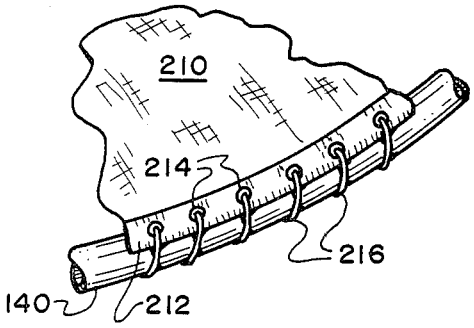
FIG. 11 illustrates the manner in which the sheet of fabric of FIG. 10 is secured to the outer ring of the form array.

The form 20 is adapted to have a sheet of flexible fabric, such as strong nylon placed over the top of the frame array so as to rest upon the top surface of the rib supports as well as the top surface of the panels 200. Preferably, the fabric 210, best illustrated in FIGS. 10 and 11, has a peripheral reinforced edge 212 containing eyelets 214 and is sized and shaped so that in the relaxed condition, the reinforced peripheral edge 212 is juxtaposed the outer ring member 140. Thus, a cord or rope 216 may be readily passed through eyelets 214 and around the outer ring member 140 to secure one to the other. The fabric 210 comprises a radial seam having opposed reinforced edges 218, each edge comprising eyelets 220 which are laced together with cord or rope 222 into a closed condition, as illustrated in FIG. 10, when the form 20 is relaxed.

Figure 3:
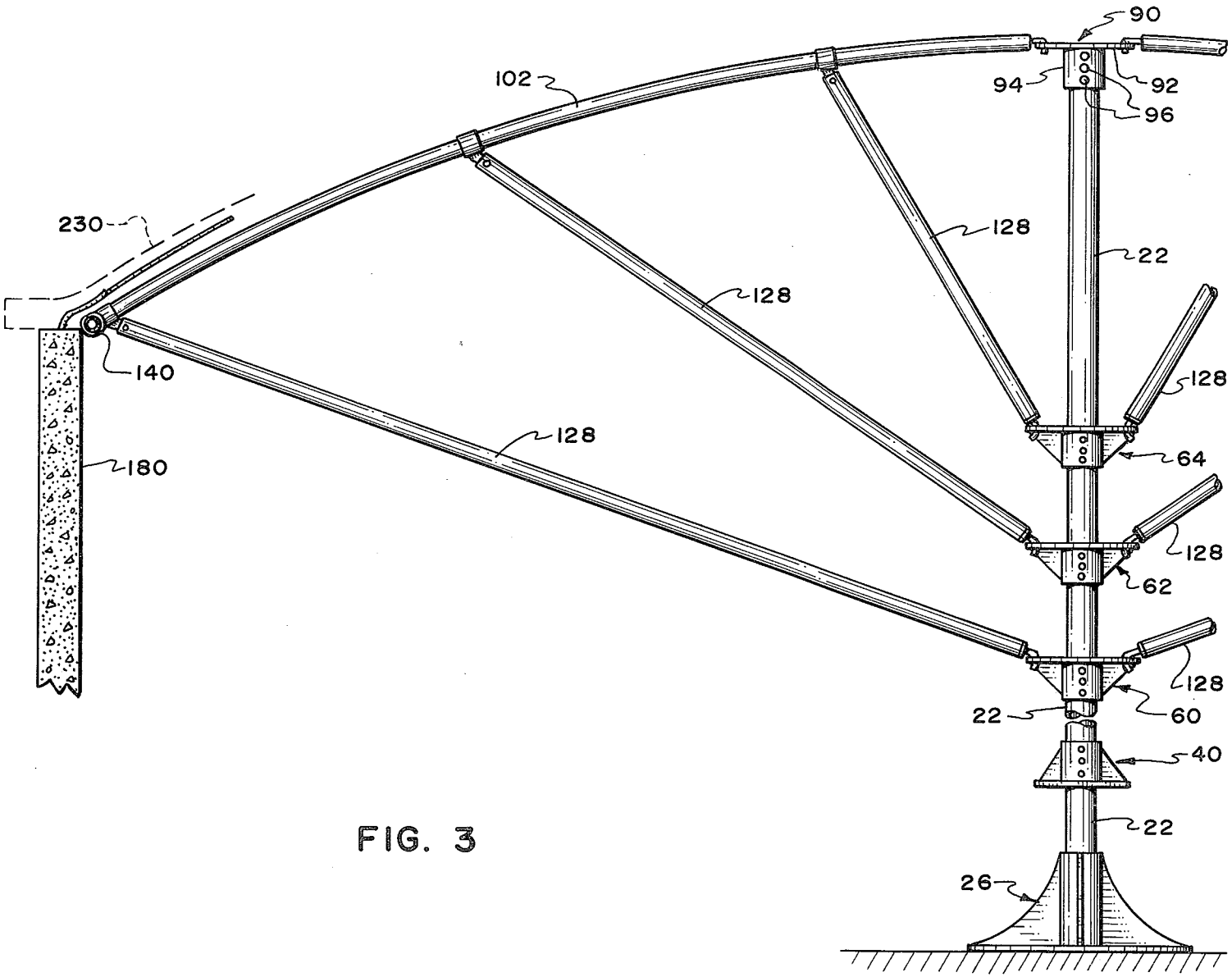
FIG. 3 is a vertical cross section centrally through the concrete form of FIG. 1.
Figure 10:
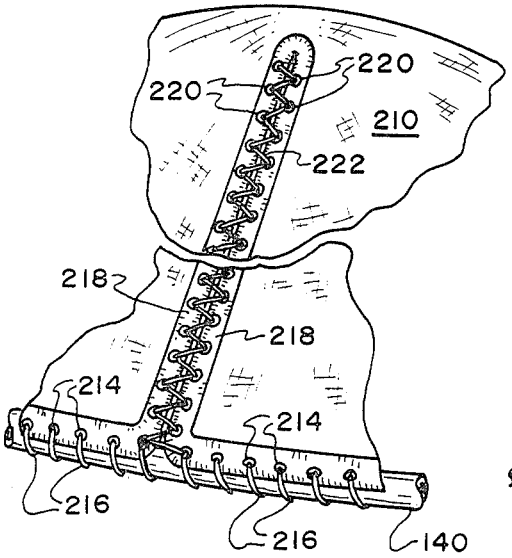
FIG. 10 is a fragmentary perspective representation illustrating the sheet of fabric used on top of the concrete form and particularly the radial seam of said sheet of fabric.

With the fabric 210 placed upon the dome array as illustrated in FIG. 10 and the three sets of struts 128 connected to the rib supports 102 as illustrated in FIG. 3, the connectors 64, 62 and 60 are independently elevated, with the L-shaped rod ends 112 fitted into the peripheral apertures 74 of the appropriate ones of said strut connectors. A hydraulic or like jacking mechanism may be used to successively elevate each of the connectors 64, 62 and 60 so that the frame array is appropriately configurated and the effective radial distance is set to match the previously erected structural columns 180. The proper location of the connectors 64, 62 and 60 along the column 22 is thereafter maintained by placement of pins through the previously described aligned pairs of apertures. The circumference of the outer ring support 140 may be varied using one or more of the previously described mechanisms 182 and the precise vertical elevation may be established using a hydraulic or like jack interposed between the base 26 and the jack abutment 40 as described. In this fashion, the form is upwardly and outwardly flexed and, as a consequence, the fabric 210 becomes taut.

Figure 12:
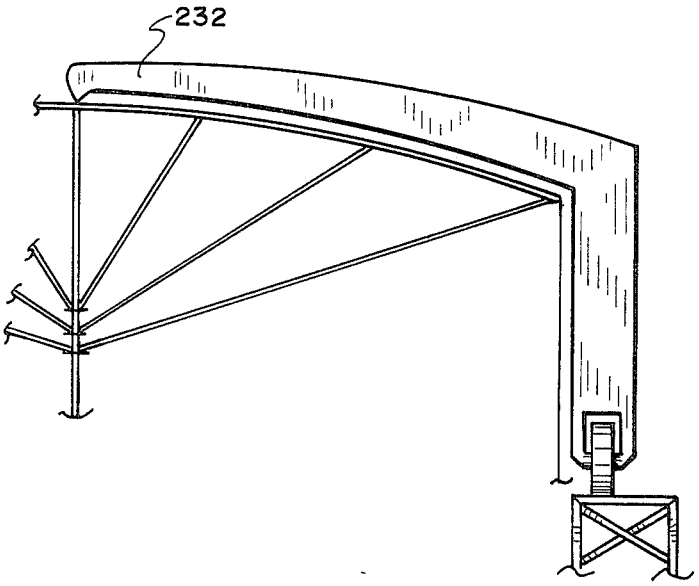
FIG. 12 is a schematic representation of one way of screeding a layer of concrete supported by the collapsible form of FIG. 1.

The lightweight concrete form 20 has been found through prototype experimentation to have more than adequate strength to maintain its concrete-receiving configuration as illustrated in FIG. 3. Where no deflection can be tolerated, the outer ring member 140 may be vertically supported by temporary columns during the concrete pour. The concrete is placed by conventional equipment such as a crane with concrete bucket across the form and such is finished by hand or screeded using a rotating arm 232 as illustrated in FIG. 12 to provide the desired thickness and exposed surface for the concrete shell 230. It should be appreciated that in most instances the concrete shell 230 would contain steel reinforcement and be on the order of two to four inches thick. If desired, post stressing may also be used to eliminate the need for the placement of conventional roofing material over the exposed exterior surface of the concrete shell 230. It should be appreciated that while the concrete shell 230 is of an arcuate dome configuration, the peripheral edge and the exterior and interior surfaces may be round, planar, polygonal or the like as desired.

Once the layer of concrete has been placed, set and cured sufficient to support its own weight, the form 20 may readily be removed. The entire form may be lowered by lowering the column 22 into the base 26. The strut connectors are also rectilinearly lowered along the column 22. This in effect will remove the load and constrict or relax the effective diameter of the concrete form 22. Thereafter, disassembly is attended to in the reverse order of the assembly procedure, i.e. the lower ends of the struts 128 are removed from the connector 60, 62 and 64 at a point in time when no load is being carried by the form 20. The upper ends of the struts 128 may be removed by loosening the bolts 130. The intermediate ring sections 162 are removed by slipping them from the connectors 164 and the rib supports 102 are removed from the top connector 90 by lifting the L-shaped rod ends 112 from the apertures of the plate 92, all at a point in time after the fabric 210 has been disconnected from the outer ring member 140, unlaced along its radial seam at 218 and removed along with the panels 200. The assembly and disassembly can be attended to using personnel having very little training or expertise. The described concrete form 20 can be reused almost without limitation, making the cost of fabricating a concrete shell roof with the present invention relatively low in comparison with other available alternatives. In addition, the form is extremely strong and yet light weight so that it is portable and may be readily transported from place to place, assembled and disassembled without a major expenditure in time and labor.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A collapsible and reusable concrete form comprising:

a vertical column;

a base associated with the column;

a connector at the top of the column;

at least one intermediate strut connector carried by the column for relative axial displacement in respect to the column and means for securing said strut connector in any selected one of a plurality of axial positions;

a plurality of outwardly and downwardly extending radially directed members associated with concrete form means, each radially directed member being rotatably joined to the top connector;

load-bearing form means bridging between and supported by said radially directed members;

at least one diagonal strut rotatably connected to each radially directed member and respectively spanning from said connection to and connecting with the strut connector;

whereby the radially directed members are (a) flexed into a greater diametral span by upward displacement of the struts caused by elevating the strut connectors along the column and (b) relaxed into a lesser diametral span by downward displacement of the struts caused by lowering the strut connectors along the column.

2. A collapsible and reusable concrete form according to claim 1 comprising at least two strut connectors and at least two diagonal struts rotatably connected at spaced locations to each radially directed member and respectively spanning from said spaced locations to and connecting with opposite ones of the strut connectors.

3. A collapsible and reusable concrete form according to claim 1 wherein said form means comprise a sheet of flexible material disposed over the radially directed members and upon which concrete is placed.

4. A collapsible and reusable concrete form according to claim 1 wherein said vertical column is a hollow tube having a plurality of horizontally aligned pairs of opposed apertures.

5. A collapsible and reusable concrete form according to claim 4 further comprising a jack abutment connected to the column a short distance above the base, the base telescopically receiving the proximal end of the column, the base presenting a plurality of aligned pairs of apertures at least one pair of which is to be aligned with at least one aligned pair of apertures in the column by elevating the column relative to the base caused by force imposed upon said abutment and into which a pin may be placed to retain the desired column elevation.

6. A collapsible and reusable concrete form according to claim 1 further comprising a plurality of ring means interconnecting said radially directed members, one of said ring means comprising outer ring means connected to the distal ends of the radially directed members.

7. A collapsible and reusable concrete form according to claim 6 further comprising a sheet of flexible material disposed over the radially directed members the peripheral edge of which is releasably connected to said outer ring means whereby the sheet of flexible material is caused to be taut when said radially directed members are flexed.

8. A collapsible and reusable concrete form according to claim 7 wherein said sheet of flexible material has a radially directed releasably closed seam which may be opened to facilitate removal of the flexible material.

9. A collapsible and reusable concrete form according to claim 1 wherein each of said top connector and strut connectors comprise a collar concentric about said column and a horizontal rounded plate having a plurality of spaced apertures near the periphery thereof sized and shaped to receive L-shaped ends of said struts.

10. A collapsible and reusable concrete form according to claim 1 wherein anti-rotate means are interposed between said column and said strut connector to avoid rotation of the connector.

11. A collapsible and reusable concrete form according to claim 1 wherein the rotatable connections between the struts and the radially directed members each comprise a T-fitting and pin means.

12. A collapsible and reusable concrete form according to claim 1 wherein the column and base are connected by means which allow adjustment of the top of the column downwardly away from a set concrete dome roof previously poured on the form, to aid in dismantling the form.

13. A collapsible and reusable concrete form comprising:

a vertical column;

a base associated with the column;

a connector at the top of the column;

at least one intermediate strut connector carried by the column for relative axial displacement in respect to the column and means for securing said strut connector in any selected one of a plurality of axial positions;

a plurality of outwardly and downwardly extending radially directed members associated with concrete form means, each radially directed member being rotatably joined to the top connector;

form means bridging between and supported by said radially directed members, said form means comprising a plurality of removable panel inserts interposed between and flush with the top of the radially directed members;

at least one diagonal strut rotatably connected to each radially directed member and respectively spanning from said connection to and connecting with the strut connector;

whereby the radially directed members are (a) flexed into a greater diametral span by upward displacement of the struts caused by elevating the strut connectors along the column and (b) relaxed into a lesser diametral span by downward displacement of the struts caused by lowering the strut connectors along the column.

14. A collapsible and reusable concrete form comprising:

a vertical column;

a base associated with the column;

a connector at the top of the column;

at least one intermediate strut connector carried by the column for relative axial displacement in respect to the column and means for securing said strut connector in any selected one of a plurality of axial positions;

a plurality of outwardly and downwardly extending radially directed members associated with concrete form means, each radially directed member being rotatably joined to the top connector;

form means bridging between and supported by said radially directed members;

a plurality of ring means interconnecting said radially directed members, one of said ring means comprising outer ring means connected to the distal ends of the radially directed members;

at least one diagonal strut rotatably connected to each radially directed member and respectively spanning from said connection to and connecting with the strut connector;

whereby the radially directed members are (a) flexed into a greater diametral span by upward displacement of the struts caused by elevating the strut connectors along the column and (b) relaxed into a lesser diametral span by downward displacement of the struts caused by lowering the strut connectors along the column;

said outer ring means comprises means for varying the circumference of said outer ring means whereby the diametrical span of said outer ring means may be increased during flexing of the radially directed members and decreased when said members are relaxed.

15. A collapsible and reusable concrete form comprising:

a vertical column;

a base associated with the column;

a connector at the top of the column;

at least one intermediate strut connector carried by the column for relative axial displacement in respect to the column and means for securing said strut connector in any selected one of a plurality of axial positions;

a plurality of outwardly and downwardly extending radially directed members associated with concrete form means, each radially directed member being rotatably joined to the top connector;

form means bridging between and supported by said radially directed members;

at least one diagonal strut rotatably connected to each radially directed member and respectively spanning from said connection to and connecting with the strut connector;

whereby the radially directed members are (a) flexed into a greater diametral span by upward displacement of the struts caused by elevating the strut connectors along the column and (b) relaxed into a lesser diametral span by downward displacement of the struts caused by lowering the strut connectors along the column;

a ring inter-connecting the distal ends of the radially directed members and also comprising means for increasing or decreasing the circumference of said ring.

16. A reusable concrete form comprising:

a vertical column;

a base receiving the lower end of the column in telescopic relation;

means for selectively varying and thereafter holding the vertical location of the lower end of the column with respect to the base so that the top of the column is thereby placed at a desired elevation;

a plurality of beam members spanning radially between and connected with the top of the column and an outer ring member disposed in a horizontal plane substantially below the top of the column;

a load-bearing form means connected to and supported by the beam members at least one strut connector slidably mounted to the column intermediate to the length of the column;

releasable means for stationarily holding the strut connector in an elevated position or a lowered position along the column;

at least one strut diagonally spanning between and connecting with the strut connector and an intermediate location along each beam member whereby when the strut connector is in said elevated position the beam members are upwardly flexed to receive and support concrete and when the strut connector is in said lowered position the beam members are downwardly relaxed.

* * * * *